US009058006B2

(12) United States Patent
Hotta

(10) Patent No.: US 9,058,006 B2
(45) Date of Patent: Jun. 16, 2015

(54) PUNCHING PROCESSING APPARATUS, SHEET POST-PROCESSING APPARATUS, AND IMAGE FORMING APPARATUS

(71) Applicant: Michihiro Hotta, Kanagawa (JP)

(72) Inventor: Michihiro Hotta, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 23 days.

(21) Appl. No.: 13/914,943

(22) Filed: Jun. 11, 2013

(65) Prior Publication Data

US 2013/0343796 A1 Dec. 26, 2013

(30) Foreign Application Priority Data

Jun. 22, 2012 (JP) ..... 2012-141218
Mar. 14, 2013 (JP) ..... 2013-051804

(51) Int. Cl.

| | |
|---|---|
| ***G03G 15/00*** | (2006.01) |
| ***B26F 1/00*** | (2006.01) |
| ***B26D 7/27*** | (2006.01) |
| ***B26D 7/01*** | (2006.01) |

(52) U.S. Cl.
CPC ..... *G03G 15/6582* (2013.01); *B26F 1/0092* (2013.01); *B26D 7/27* (2013.01); *B26D 7/015* (2013.01)

(58) Field of Classification Search
CPC .... G03G 15/6582; B26F 1/0092; B26B 7/015
USPC ..... 399/407; 412/18; 83/405, 684
See application file for complete search history.

(56) References Cited

U.S. PATENT DOCUMENTS

| | | | | |
|---|---|---|---|---|
| 7,003,257 | B2 * | 2/2006 | Yoshie et al. | 399/389 |
| 2002/0079640 | A1 * | 6/2002 | Yoshie et al. | 271/176 |
| 2003/0080487 | A1 | 5/2003 | Tamura et al. | |
| 2003/0215275 | A1 | 11/2003 | Tamura et al. | |
| 2005/0061131 | A1 | 3/2005 | Tamura et al. | |
| 2005/0115377 | A1 * | 6/2005 | Kobayashi | 83/684 |
| 2005/0211035 | A1 | 9/2005 | Tamura et al. | |
| 2006/0022394 | A1 | 2/2006 | Tamura et al. | |
| 2007/0051219 | A1 | 3/2007 | Tamura et al. | |
| 2007/0052147 | A1 | 3/2007 | Tamura et al. | |

FOREIGN PATENT DOCUMENTS

| | | |
|---|---|---|
| JP | H11-139674 | 5/1999 |
| JP | 2003-117893 | 4/2003 |
| JP | 4592403 | 9/2010 |

* cited by examiner

*Primary Examiner* — Matthew G Marini
(74) *Attorney, Agent, or Firm* — Harness, Dickey & Pierce P.L.C.

(57) ABSTRACT

A punching processing apparatus includes: a punching scrap collection member that is disposed at a position where punching scraps produced after punching a sheet drop; a punching scrap housing unit that is disposed in the punching scrap collection member and movable in a horizontal direction; a registration detection unit that is movable in a width direction of the sheet for detecting a positional deviation amount of the sheet in the width direction when a position of the sheet in the width direction is adjusted so as to meet a punching position, wherein punching scraps accumulated in the punching scrap housing unit are shaken and flattened out by causing the punching scrap housing unit to move in the horizontal direction in coordination with the movement of the registration detection unit.

13 Claims, 15 Drawing Sheets

PUNCHING PROCESSING APPARATUS, SHEET POST-PROCESSING APPARATUS, AND IMAGE FORMING APPARATUS

CROSS-REFERENCE TO RELATED APPLICATIONS

The present application claims priority to and incorporates by reference the entire contents of Japanese Patent Application No. 2012-141218 filed in Japan on Jun. 22, 2012 and Japanese Patent Application No. 2013-051804 filed in Japan on Mar. 14, 2013.

BACKGROUND OF THE INVENTION

1. Field of the Invention

The present invention relates to a punching processing apparatus, a sheet post-processing apparatus, and an image forming apparatus.

2. Description of the Related Art

In image forming apparatuses such as copiers, printers, facsimiles, and printing machines, image outputs can be obtained by forming visible images such as toner images on sheets. Unlike a case where the sheets are sequentially discharged to discharge trays from the image forming apparatuses, sheets after image forming are in some cases conveyed to sheet post-processing apparatuses that perform post-processing, such as punching the sheets for filing, affixing seals, or adding information on the sheets, and the sheets are sorted into sheet groups.

The sheet post-processing apparatuses are mostly used by being connected at the sheet discharge positions of the image forming apparatuses. In an example of the such sheet post-processing apparatuses, a sheet conveyed into the sheet post-processing apparatus is subjected to punching processing for filing and then to succeeding processing such as binding processing, and thereafter discharged. One of the reasons why the punching processing is performed first is that, when the binding processing is performed as the next processing, it is difficult to perform punching because staples used in the binding processing hinder the punching.

In punching, punched holes are formed in a predetermined edge area of the conveyed sheet. There are various types of punched holes. For a typical example, two holes, three holes, and four holes are frequently used in Japan and in Europe. As for a diameter of a punched hole in punching, two holes having a diameter of 6.5 mm are used in Japan whereas two holes or three holes having a diameter of 8 mm are selected in some cases in North America, and in Europe, four holes having a diameter of 6.5 mm are used. In Northern Europe, four holes arranged with uneven intervals are selected in some cases. In addition to the types described above, multiple holes for a binder are used, for example.

Punching scraps produced in punching are collected by being dropped into a container such as a punching scrap collection member disposed at the punching processing position. The collected punching scraps are dropped and accumulated in the container. In most cases, as illustrated in FIG. 17, the collected punching scraps are accumulated like a mountain (indicated with the heavy two-dot chain line in FIG. 17). In recent years, with the downsizing of the apparatus, the size of the container tends to be reduced in volume. As a result, a frequency of disposal may be increased depending on an amount of the dropped and accumulated punching scraps.

A structure that detects the height of the accumulated punching scraps is well known as a structure for detecting disposal of the punching scraps. In the structure, a detection sensor provided at a predetermined height detects a full state of the punching scraps and warns of disposal of the punching scraps in the container.

In the case of the punching scraps accumulated like a mountain, the punching scraps may be accumulated in one part of the container. The whole of the container may not always be filled with the punching scrapes. Conventionally, a structure has been proposed in which a false detection due to the accumulation like a mountain is prevented and the punching scraps are efficiently collected by breaking down the punching scraps accumulated like a mountain. For example, refer to Japanese Patent No. 4592403 and Japanese Patent Application Laid-open No. 11-139674.

In Japanese Patent No. 4592403, punching processing apparatuses having the following structures are described. In the punching processing apparatus, a punching scrap housing unit is provided that can reciprocate in the horizontal direction in a punching scrap collection member, and punching scrapes are flattened out by reciprocating the punching scrap housing unit using excitation of a solenoid. In addition, in the other punching processing apparatus, the bottom surface of the punching scrap housing unit is an elastic body and the punching scraps are broken down and flattened out by vibrating the bottom portion. In Japanese Patent Application Laid-open No. 11-139674, a punching processing apparatus is described that has a structure in which punching scraps accumulated like a mountain are flattened out by knocking the bottom surface of a punching scrap collection member (punching scrap housing unit) so as to vibrate the punching scrap collection member. The reciprocating and vibrating are performed when a sensor is on that is provided to the punching scrap collection member or the punching scrap housing unit and detects the height of the punching scraps.

The structure described in Japanese Patent No. 4592403 requires a driving source for reciprocating or vibrating up and down the punching scrap housing unit to be provided in the vicinity of the punching scrap housing unit. The volume of the punching scrap housing unit provided in the punching scrap collection member is reduced due to the space for the driving source. As a result, it is difficult to reduce the frequency of disposal because the collection amount of punching scraps cannot be increased. The special driving source required for reciprocating or vibrating operation may increase the apparatus in size and increase cost due to an increase in the number of parts.

In the structure described in Japanese Patent Application Laid-open No. 11-139674, the vibrated punching scraps behave unstable because the punching scraps are flattened out by being vibrated. For example, the punching scraps scatter as far as the location of the sensor detecting the height. This may lead to a determination that the height of the accumulated punching scraps corresponds to the full state though the punching scraps is being vibrated and flattened out, and lower the detection accuracy.

Therefore, it is desirable to provide a punching processing apparatus that can be provided without an increase in size and cost, and avoid false detection of the height of the accumulated punching scraps, i.e., a false determination that the container is in a full state even though the state has been corrected to the actual state.

SUMMARY OF THE INVENTION

It is an object of the present invention to at least partially solve the problems in the conventional technology.

According to an aspect of the present invention, there is provided a punching processing apparatus including: a punching scrap collection member that is disposed at a position where punching scraps produced after punching a sheet drop; a punching scrap housing unit that is disposed in the punching scrap collection member and movable in a horizontal direction; a registration detection unit that is movable in a width direction of the sheet for detecting a positional deviation amount of the sheet in the width direction when a position of the sheet in the width direction is adjusted so as to meet a punching position, wherein punching scraps accumulated in the punching scrap housing unit are shaken and flattened out by causing the punching scrap housing unit to move in the horizontal direction in coordination with the movement of the registration detection unit.

According to another aspect of the present invention, there is provided a sheet post-processing apparatus capable of performing binding processing on a sheet, the sheet post-processing apparatus including the punching processing apparatus, the punching processing apparatus including: a punching scrap collection member that is disposed at a position where punching scraps produced after punching a sheet drop; a punching scrap housing unit that is disposed in the punching scrap collection member and movable in a horizontal direction; a registration detection unit that is movable in a width direction of the sheet for detecting a positional deviation amount of the sheet in the width direction when a position of the sheet in the width direction is adjusted so as to meet a punching position, wherein punching scraps accumulated in the punching scrap housing unit are shaken and flattened out by causing the punching scrap housing unit to move in the horizontal direction in coordination with the movement of the registration detection unit.

According to still another aspect of the present invention, there is provided an image forming apparatus that forms an image on a sheet, the image forming apparatus including a punching processing apparatus, the punching processing apparatus including: a punching scrap collection member that is disposed at a position where punching scraps produced after punching a sheet drop; a punching scrap housing unit that is disposed in the punching scrap collection member and movable in a horizontal direction; a registration detection unit that is movable in a width direction of the sheet for detecting a positional deviation amount of the sheet in the width direction when a position of the sheet in the width direction is adjusted so as to meet a punching position, wherein punching scraps accumulated in the punching scrap housing unit are shaken and flattened out by causing the punching scrap housing unit to move in the horizontal direction in coordination with the movement of the registration detection unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENT

Figure 1:
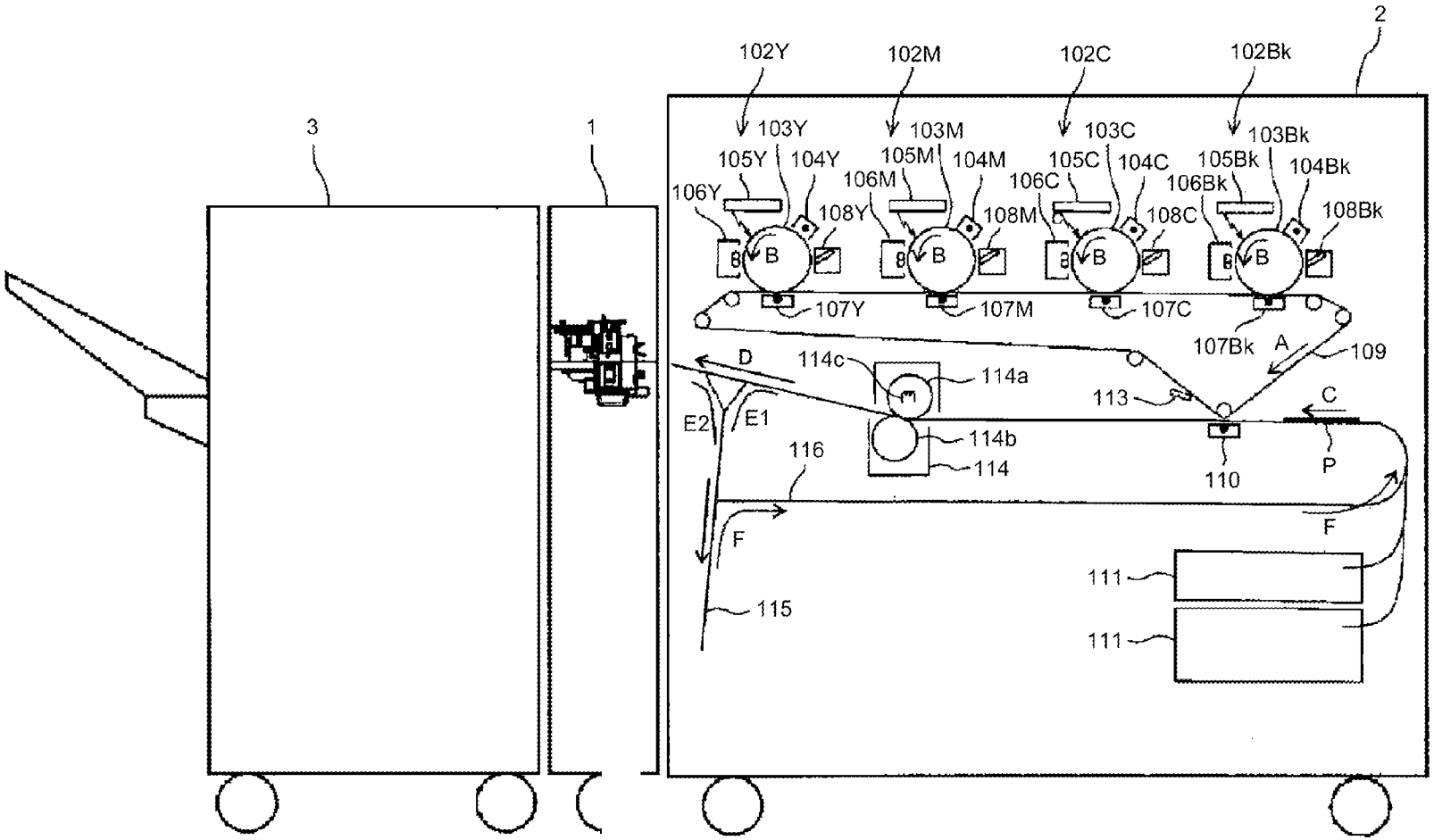
FIG. 1 is a schematic diagram for explaining an image forming apparatus that includes a sheet post-processing apparatus and for which a punching processing apparatus according to an embodiment of the invention is used.

An embodiment of the invention is described below with reference to the accompanying drawings. FIG. 1 is a schematic diagram illustrating an image processing system using a punching processing apparatus according to an embodiment of the invention. As illustrated in FIG. 1, a punching processing apparatus 1 is disposed adjacent to a sheet discharging position of an image forming apparatus 2 such as a printer. A sheet post-processing apparatus 3, which performs post-processing such as binding processing, is disposed downstream in a conveying direction of a sheet P (hereinafter referred to as a sheet conveying direction), which is a recording sheet material such as a sheet discharged from the punching processing apparatus 1.

The image forming apparatus 2 in the embodiment is an electrophotographic full-color image forming apparatus employing an intermediate transfer method using an intermediate transfer belt and a tandem system in which a plurality of image forming units are provided on a stretched surface of the intermediate transfer belt. The image forming apparatus 2 includes four image forming units 102Y, 102M, 102C, and 102Bk, which correspond to yellow (Y), magenta (M), cyan (C), and black (Bk), respectively, arranged along a running direction of an intermediate transfer belt 109 as illustrated in FIG. 1. The image forming unit 102Y is composed of a photosensitive drum 103Y serving as an image carrier, a drum charger 104Y, an exposing device 105Y, a developing unit 106Y, a transfer unit 107Y, and a cleaning device 108Y, for example. The image forming units 102M, 102C, and 102Bk have the same structure as the image forming unit 102Y. The image forming units 102Y, 102M, 102C, and 102Bk form images of the corresponding respective colors of yellow, magenta, cyan, and black.

The photosensitive drum 103Y starts rotating in a direction of arrow B in FIG. 1 when receiving a start instruction signal of an image forming operation from a control unit (not illustrated) of the image forming apparatus and continues to rotate until the completion of the image forming operation. Once the photosensitive drum 103Y starts rotating, a high voltage is applied to the drum charger 104Y, resulting in negative charges being uniformly charged on a surface of the photosensitive drum 103Y. Image data such as character data converted into a dot image and graphic data is sent from the control unit of the image forming apparatus as a signal turning on or off the exposing device 105Y. The exposing device 105Y irradiates the surface of the photosensitive drum 103Y with laser light in accordance with the image data. A latent image corresponding to the image data is formed on the photosensitive drum 103Y in an area in which the charges are reduced by being irradiated with laser light by the exposing device 105Y. When the formed latent image reaches a position facing the developing unit 106Y with the rotation of the photosensitive drum 103Y, negatively charged toner of the developing unit 106Y is attracted to the latent image, resulting in a toner image being formed on the photosensitive drum 103Y.

The toner image formed on the photosensitive drum 103Y reaches the transfer unit 107Y serving as a primary transfer unit with the rotation of the photosensitive drum 103Y. The toner image is transferred by the action of a high voltage applied to the transfer unit 107Y onto the intermediate transfer belt 109 rotating in a direction of arrow A in FIG. 1. Toner remaining on the photosensitive drum 103Y without being transferred after passing the transfer position (image transfer portion), is removed by the cleaning device 108Y from the photosensitive drum 103Y. The photosensitive drum 103Y after the cleaning is ready for the next image forming operation.

After the operation of the image forming unit 102Y, the image forming unit 102M performs the image forming operation in the same manner as the image forming unit 102Y, in which a toner image formed on a photosensitive drum 103M is transferred onto the intermediate transfer belt 109 by the action of a high voltage applied to a transfer unit 107M.

At the time, the timing when the toner image formed by the image forming unit 102Y and transferred onto the intermediate transfer belt 109 reaches the transfer unit 107M is adjusted so as to be coincident with the timing when the toner image formed on the photosensitive drum 103M is transferred onto the intermediate transfer belt 109. As a result, the respective toner images formed by the image forming units 102Y and 102M overlap on the intermediate transfer belt 109. The toner images formed by the image forming units 102C and 102Bk overlap on the intermediate transfer belt 109 in the same manner as described above, resulting in a full-color image being formed on the intermediate transfer belt 109.

At the same time when the full-color image reaches a transfer unit 110 serving as a secondary transfer unit, the sheet P conveyed from a paper feeding unit 111 of the image forming apparatus in a direction of arrow C in FIG. 1 reaches the transfer unit 110. The full-color image on the intermediate transfer belt 109 is transferred onto the upper side of the sheet P by the action of a high voltage applied to the transfer unit 110. The sheet P on which the full-color image (an unfixed toner image) is formed is sent to a fixing device 114 after passing through a secondary transfer nip.

The fixing device 114 includes a fixing roller 114*a* and a pressing roller 114*b* pushed toward the fixing roller 114*a*. The fixing roller 114*a* and the pressing roller 114*b* are abutted to each other to form a fixing nip, in which the sheet P is sandwiched by the rollers. The fixing roller 114*a* has a heat source 114*c* serving as a heating unit therein. The fixing roller 114*a* is heated by heat generated by the heat source 114*c*. The heated fixing roller 114*a* imparts heat to the sheet P sandwiched in the fixing nip so as to heat the sheet P. The full-color image on the sheet P is fixed by the influence of heating and a nip pressure.

After the full-color image passes through the transfer unit 110, toner stuck to the intermediate transfer belt 109 that has not been transferred is removed by a belt cleaning device 113 from the intermediate transfer belt 109.

The sheet P after passing through the fixing device 114 is conveyed along different routes depending on discharging modes. In one-sided printing, the sheet P is discharged in such a manner that the side on which the full-color image is fixed is the front side, which is a face-up discharge, or in such a manner that the side on which the full-color image is fixed is the back side, which is a face-down discharge. In the face-up discharge, the sheet P after passing through the fixing device 114 is conveyed from the image forming apparatus 2 to the punching processing apparatus 1 without any change in a manner as indicated by arrow D in FIG. 1. In the face-down discharge, the sheet P after passing through the fixing device 114 is conveyed toward a switchback 115 in a manner as indicated by arrow E1. The sheet P is reversed in the switchback 115 such that the front and back sides are in reverse and conveyed from the image forming apparatus 2 to the punching processing apparatus 1 in a manner as indicated by arrow E2 in FIG. 1.

In duplex printing, the sheet P after passing through the fixing device 114 is sent to the switchback 115, and thereafter conveyed from the switchback 115 to a duplex-printing conveying route 116 in a manner as indicated by arrow F in FIG. 1 and then to the transfer unit 110 again. A full-color image formed in the same manner as described above is transferred onto the sheet P. Thereafter, the sheet P passes through the fixing device 114. The sheet P after passing through the fixing device 114 can be discharged in the manner as described above, i.e., the face-up discharge or the face-down discharge, in which the sheet P is reversed in the switchback 115.

Figure 2:
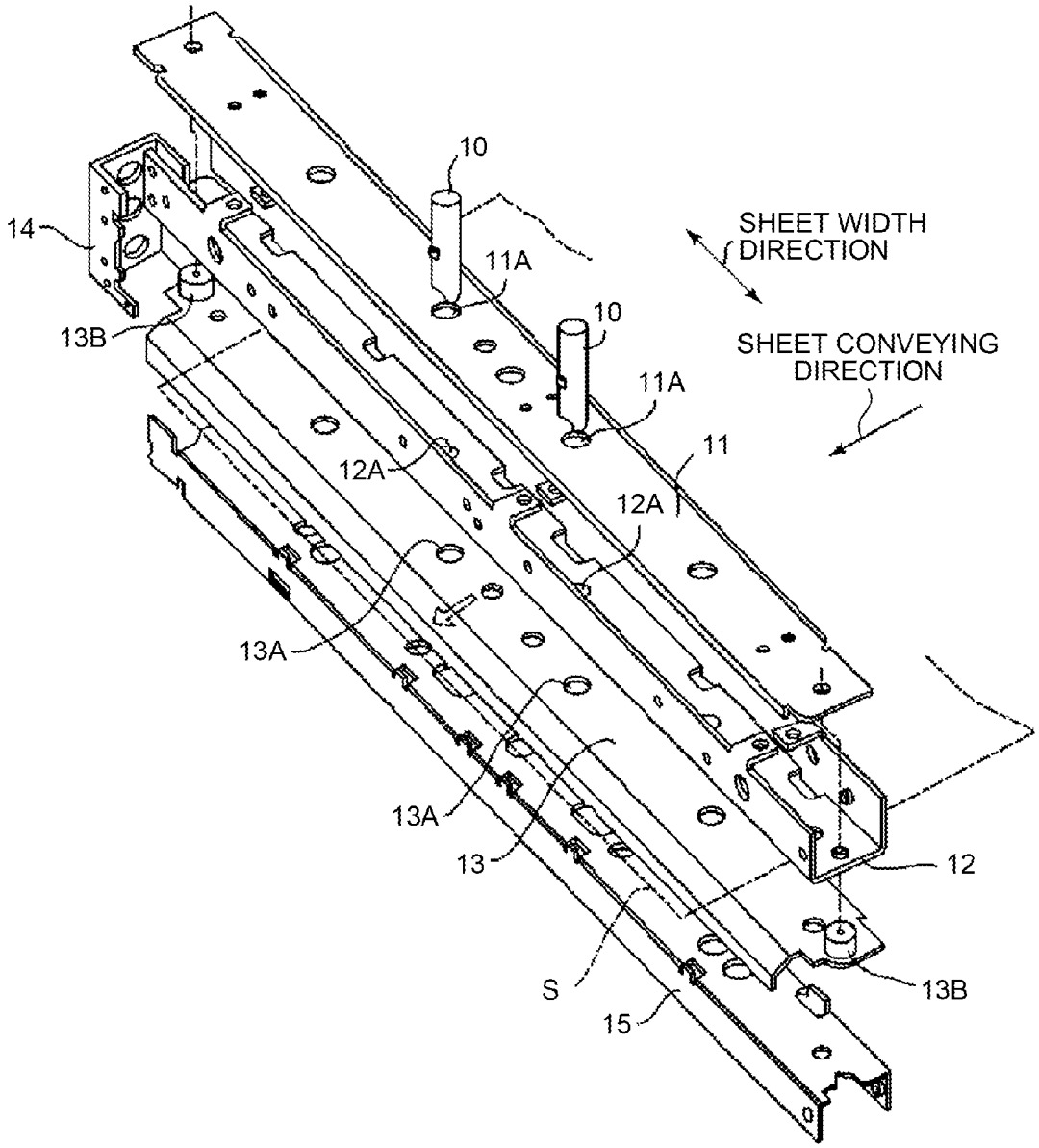
FIG. 2 is a perspective view for explaining a structure of a main portion of the punching processing apparatus in the embodiment.

The punching processing apparatus 1 has a structure for supporting punching punches 10, which are punching pins having edges for punching the sheet P formed on one edge sides thereof. The structure is illustrated in FIG. 2. In the embodiment, as illustrated in FIG. 2, two punching punches 10 are provided so as to enable punching to be performed on the sheet P at two positions in the width direction of the sheet P (hereinafter referred to as a sheet width direction) orthogonal to the sheet conveying direction. The supporting structure of the punching punches 10 includes the following components. The supporting structure includes an upper guide frame 11 having two die holes 11A formed at two positions, a lower guide frame 12 facing the upper guide frame 11, a die frame 13 serving as a die supporting the lower side of the sheet, and side plates 14, to which side surfaces of the respective frames are fastened on the right and the left sides and by which the respective frames are supported. In FIG. 2, only the side plate 14 on the left side is illustrated.

The die frame 13 has two die holes 13A formed with a distance corresponding to an arrangement pitch of the punching punches 10 therebetween. When moving up and down, the punching punches 10 pass through the die holes 13A after passing through the sheet, thereby enabling punching processing to be performed. The lower guide frame 12 also has two die holes 12A so as to enable the punching punches 10 to pass through them. The upper and lower guide frames 11 and 12, and the die frame 13 are integrally assembled by being fasten with screws inserted from the upper guide frame 11 (indicated with the chain lines in FIG. 2) to studs 13B integrated with the die frame 13. A bottom plate 15 is integrated with the integrated upper and lower guide frames 11 and 12 and the die frame 13 on the bottom thereof with the side plates 14.

Figure 3A:
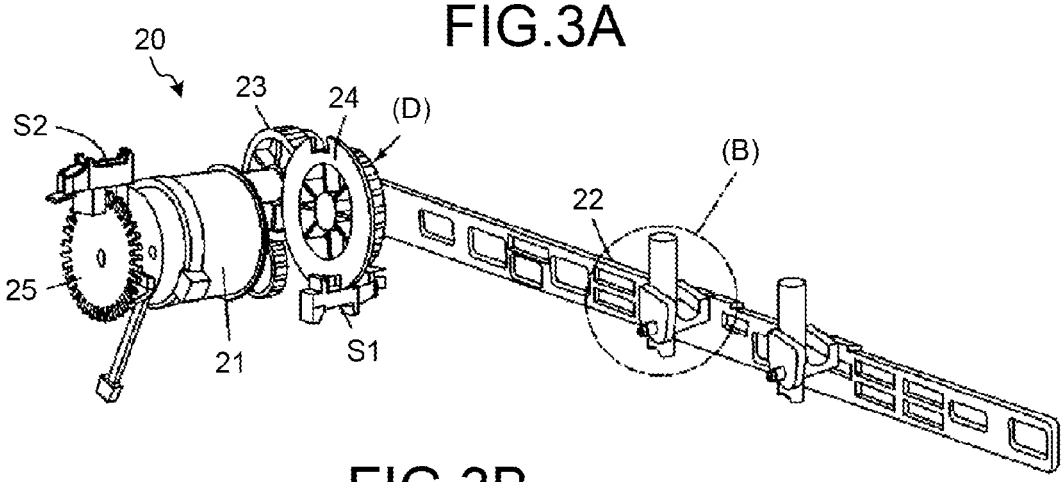
FIGS. 3A to 3D are perspective views for explaining a structure of a driving unit of the punching processing apparatus in the embodiment.
Figure 3B:
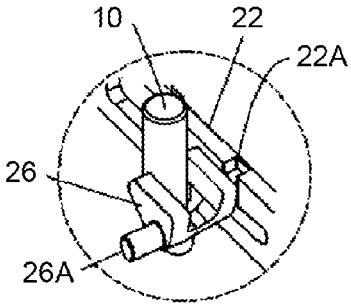

FIGS. 3A to 3D illustrate an up-down driving mechanism 20 for the punching punches 10. As illustrated in FIGS. 3A to 3D, the up-down driving mechanism 20 includes a driving motor 21, a slide lever 22, and a driving gear 23 as a main driving unit, which will be described in detail later. In FIG. 3A, a sensor filler 24 detects an initial position of the slide lever 22 in coordination with the driving gear 23. An encoder 25 detects a rotational amount of the driving motor 21. An optical sensor S1 is disposed for the sensor filler 24 to detect the positions of notches of the sensor filler 24 while an optical sensor S2 is disposed for the encoder 25 to detect the positions of notches of the encoder 25.

In the slide lever 22, which is described in detail with reference to FIG. 4, an engagement pin 26B provided to a linking member 26 serving as an up-down unit of the punching punch 10 is engaged with a engaging portion 22A and the slide lever 22 causes a linking member 26 to swing when the slide lever 22 slides.

Figure 4A:
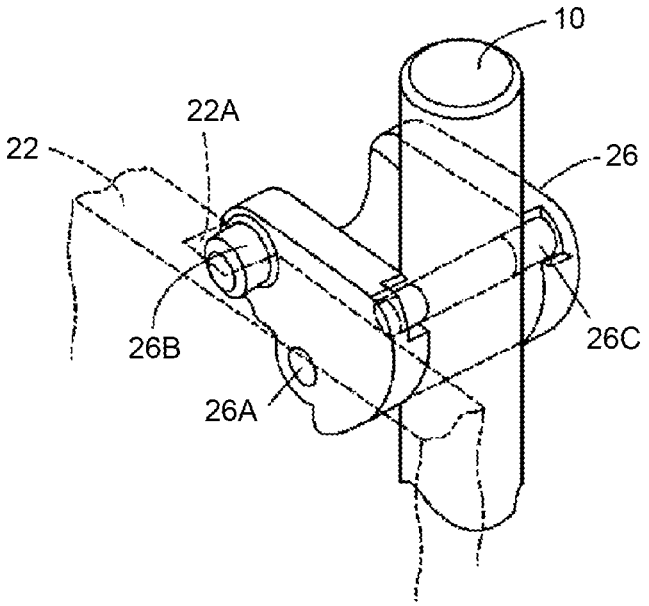
FIGS. 4A and 4B are schematic diagrams for explaining a structure of a punching punch section used in the punching processing apparatus illustrated in FIGS. 3A to 3D.
Figure 4B:
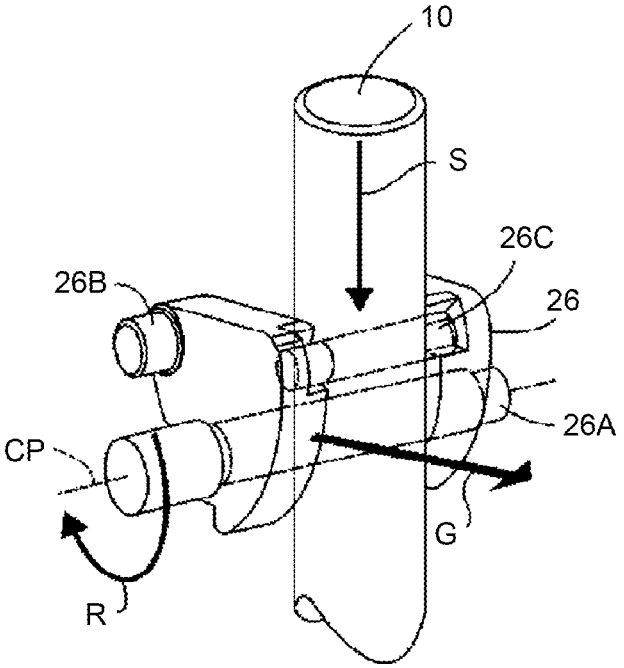

A mechanism of the swing of the linking member 22A caused by the slide lever 22 is described below with reference to FIGS. 4A and 4B. In FIG. 4A, the linking member 26, which is a swing member, is provided with a rotational shaft 26A as a swing fulcrum. The driven pin 26C penetrating through the punching punch 10 and the engagement pin 26B capable of engaging with the engaging portion 22A of the slide lever 22 are provided at a swing end. In the linking member 26, when the slide lever 22 slides in a direction indicated by arrow G in FIG. 4B, the engagement pin 26B engaged with the engaging portion 22A swings in a direction indicated by arrow R in coordination with the slide lever 22. The swing of the linking member 26 causes the punching punch 10 to move downward in a direction indicated by arrow S in accordance with the displacement of the driven pin 26C. As a result, punching is performed on the sheet P.

When the procedure described above is performed in the reversed procedure, the punching punch 10 moves upward. The movement of the punching punch 10 continues until when a determination of a return to the initial position is made by the sensor filler 24. A downward stroke in punching is determined as a rotational amount of the driving motor 21 on the basis of the thickness of the sheet P to be punched, and the rotational amount is monitored by the encoder 25.

Figure 3C:
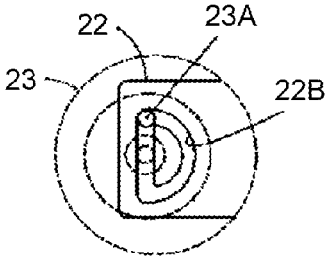
Figure 3D:
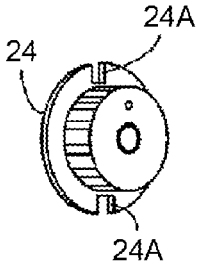
Figure 5A:
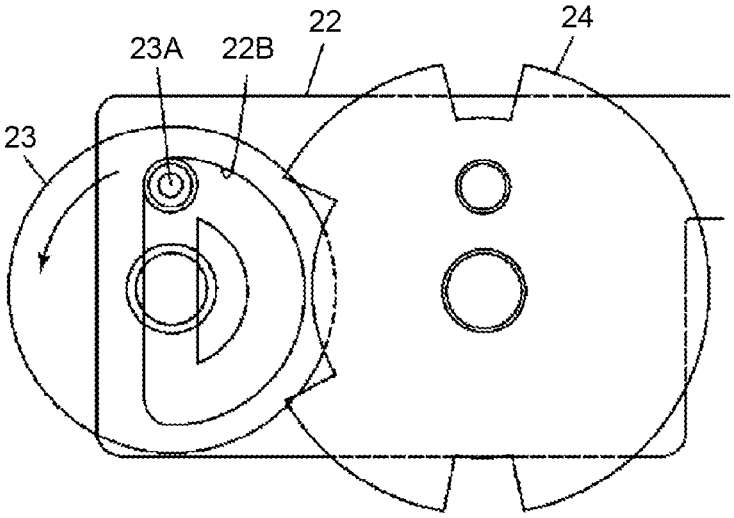
FIGS. 5A and 5B are schematic diagrams for explaining a structure of an up-down driving mechanism of the punching punch used in the punching processing apparatus illustrated in FIGS. 3A to 3D.
Figure 5B:
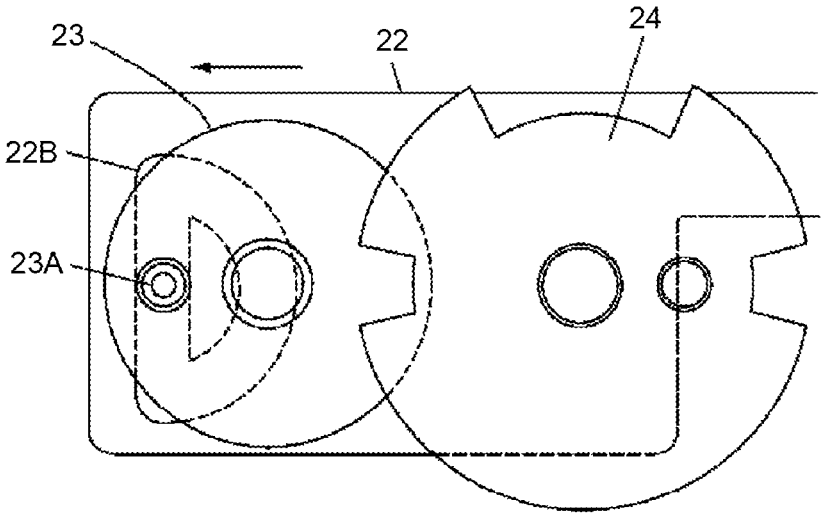

As illustrated in FIG. 3C and FIGS. 5A and 5B, a cam groove 22B is formed in the slide lever 22 in a D-character shape, and a projection 23A provided to the driving gear 23, which receives a rotation from the driving motor 21, is engaged with the cam groove 22B. When the driving gear 23 rotates, the cam groove 22B of the slide lever 22 is moved by being pulled with the rotation of the projection 23A. As a result, the slide lever 22 slides.

In FIGS. 5A and 5B, when the driving gear 23 rotates from the initial position, where the projection 23A of the driving gear 23 is positioned in a straight line portion of the cam groove 22B, the straight line portion of the cam groove 22B is pushed and moved by the projection 23A. As a result, the slide lever 22 slides. When the projection 23A is positioned in a circular portion of the cam groove 22B, the slide lever 22 is kept in a state of no sliding.

Figure 6:
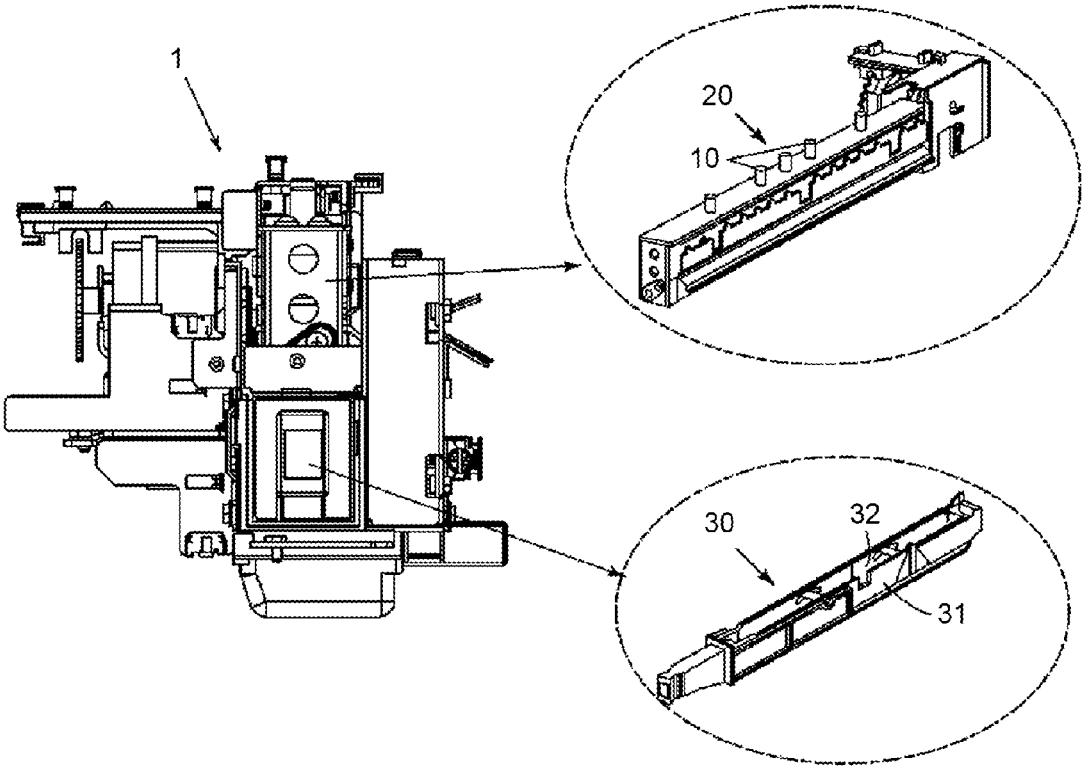
FIG. 6 is a perspective view for explaining a structure of a punching scrap collection unit used in the punching processing apparatus in the embodiment.

FIG. 6 is a structural diagram of the punching processing apparatus 1 illustrated in FIG. 1. As illustrated in FIG. 6, the punching processing apparatus 1 includes the supporting unit of the punching punches 10, the up-down driving mechanism 20 for the punching punches 10, and a punching scrap processing mechanism 30 that has also a function of a punching scrap collection mechanism serving as a collection mechanism of punching scraps.

Figure 7:
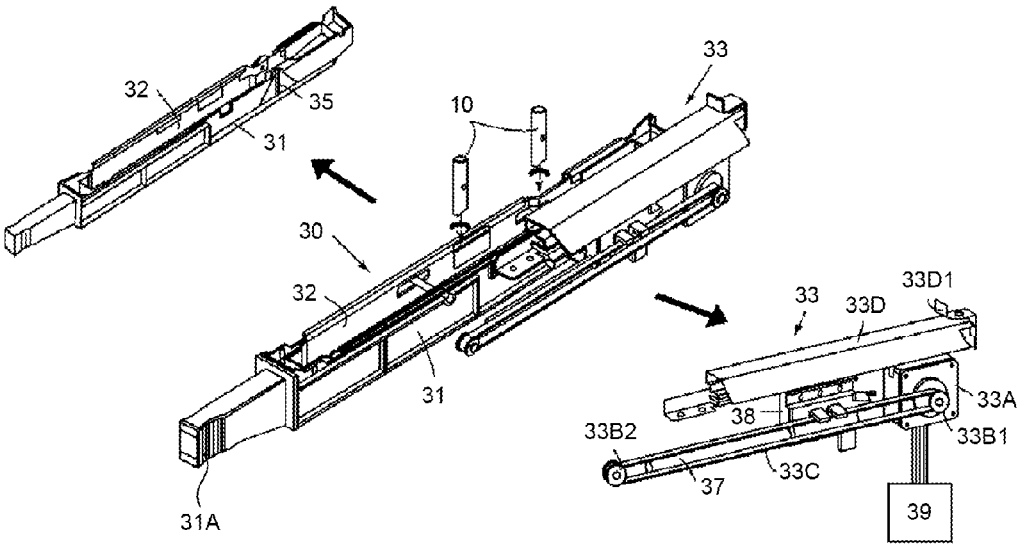
FIG. 7 is a schematic diagram for explaining a structure of a main portion of the punching scrap collection unit illustrated in FIG. 6.

FIG. 7 illustrates the punching scrap processing mechanism 30, which is a feature of the embodiment. The feature of the embodiment is that punching scraps in a punching scrap housing unit 32 housing punching scraps are shaken and flattened out in coordination with the movement of a registration detection unit 33 used as an existing unit. The structure to achieve the feature is described below.

As illustrated in FIG. 7, the punching scrap processing mechanism 30 includes a punching scrap collection member 31 that is a hopper attachable to and detachable from the apparatus, the punching scrap housing unit 32 that is disposed in the punching scrap collection member 31 and movable in the horizontal direction, and the registration detection unit 33 that is movable in the sheet width direction.

The punching scrap collection member 31 opens upward and has a grip 31A on one end in the sheet width direction corresponding to the longitudinal direction thereof. The grip 31A is used when the punching scrap collection member 31 is inserted into or removed from the main body of the apparatus.

The punching scrap housing unit 32 is a box-shaped member opening upward, and is movable in the horizontal direction in coordination with a displacement of the registration detection unit 33 using a linking member, which is described later. The punching scrap housing unit 32 has an elastic body, which is not illustrated, disposed between itself and an inner surface of the punching scrap collection member 31 on one side in the longitudinal direction. The elastic body has a function to return the punching scrap housing unit 32 to an initial setting. The elastic body returns the punching scrap housing unit 32 to an initial position when a force is released that is applied to the punching scrap housing unit 32 by a linking member engaged with the unit so as to cause the unit to move, which is described later.

The linking member used in a coordinating mechanism that causes the punching scrap housing unit 32 to move in coordination with the movement of the registration detection unit 33 is provided to a part of a sidewall of the punching scrap collection member 31 in the longitudinal direction.

Figure 8:
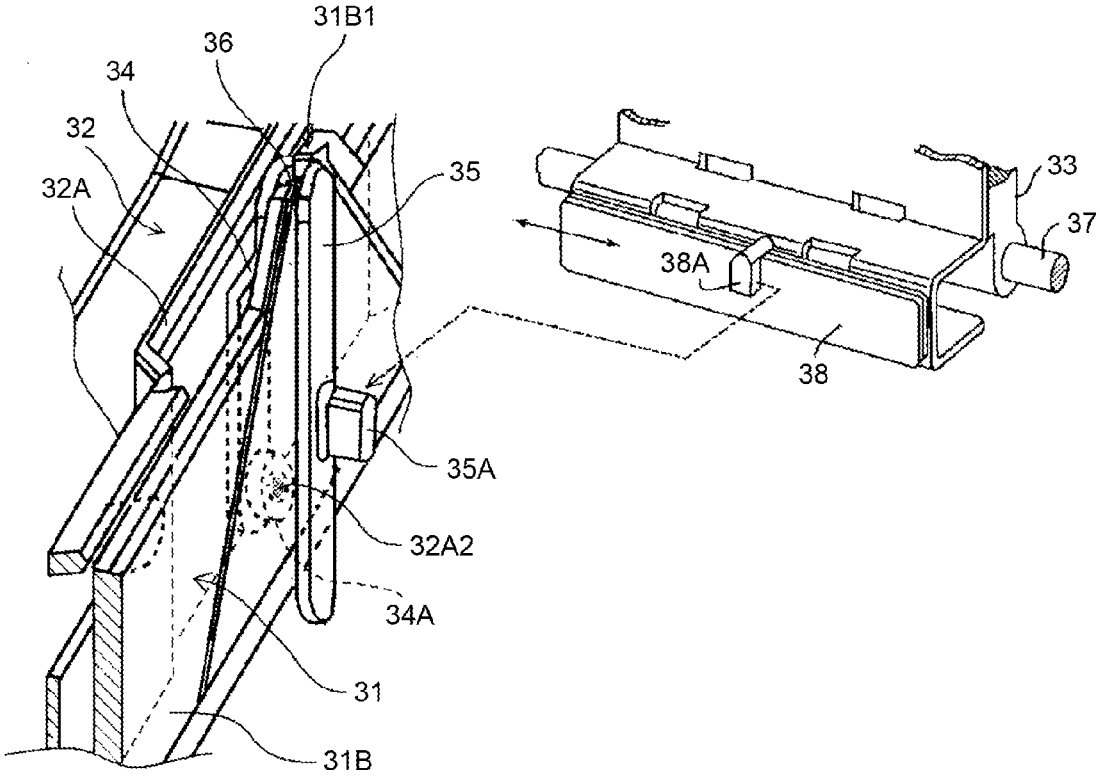
FIG. 8 is a schematic diagram for explaining an engagement relation between the punching scrap housing unit used in the structure of the main portion illustrated in FIG. 7 and a linking member, and a corresponding relation between the linking member and a cam portion provided to a registration detection unit.

The linking member includes levers 34 and 35 as a pair. Each of the levers 34 and 35 has a swing base end supported in such a manner that it straddles a swing supporter provided at the upper portion of a sidewall 31B of the punching scrap collection member 31 facing a sidewall 32A of the punching scrap housing unit 32. The detail is illustrated in FIG. 8. As illustrated in FIG. 8, a supporting hole 31B1, which serves as the swing supporter supporting a rotational shaft 36 provided as the swing base end of the levers 34 and 35, is formed at the upper portion of the sidewall 31B of the punching scrap collection member 31 facing the sidewall 32A of the punching scrap housing unit 32. The rotational shaft 36 is engaged with and also supported by the supporting hole 31B1 and causes the levers 34 and 35, which are integrated by being fixed to the both ends of the rotational shaft 36, to swing together in the same direction.

The lever 34, which is one lever included in the linking member, is provided with a tubular engagement hole 34A on the swing end side thereof, which is the end portion of the lever 34 extended downward along the sidewall 32A of the punching scrap housing unit 32. The engagement hole 34A is engaged with an engagement projection 32A2 serving as an engagement portion formed on the sidewall 32A of the punching scrap housing unit 32. That is, the lever 34, which is one lever included in the linking member, is engaged with the punching scrap housing unit 32. The engagement projection 32A2 is provided to the wall surface where the sidewall 32A of the punching scrap housing unit 32 is formed in a concave shape such that the lever 34 provided with the tubular engagement hole 34A can swing smoothly. The engagement projection 32A2 is used as the portion that transmits the movement in the horizontal direction of the lever 34 to the punching scrap housing unit 32 when the lever 34 is swinging.

The lever 35, which is the other lever included in the linking member, is provided with a driven cam 35A on the swing end side thereof, which is the end portion of the lever 35 extended downward along the sidewall 31B of the punching scrap collection member 31. The driven cam 35A projects toward the registration detection unit 33. A cam portion 38A is provided that is projected from a supporting table 38 provided to the registration detection unit 33 toward the driven cam 35A. When the registration detection unit 33 moves in the horizontal direction along a stud 37 in accordance with a procedure described later, the cam portion 38A provided to the supporting table 38 abuts the driven cam 35A of the lever 35, thereby causing the lever 35 to swing. When the lever 35 is swinging, the lever 34 integrally provided with the lever 35 with the rotational shaft 36 interposed therebetween also swings in the same direction. As a result of the displacement of the engagement hole 34A described above, the punching scrap housing unit 32 having the engagement projection 32A2, which is engaged with the engagement hole 34A, moves in the horizontal direction. In FIG. 8, the two-headed arrow indicates the movement of the related components.

Elastic bodies such as helical springs (not illustrated) are provided by being wound to the levers 34 and 35. The elastic bodies urge the respective levers 34 and 35 to be set at the respective initial positions in a pendulous manner as illustrated in FIG. 8.

Figure 9:
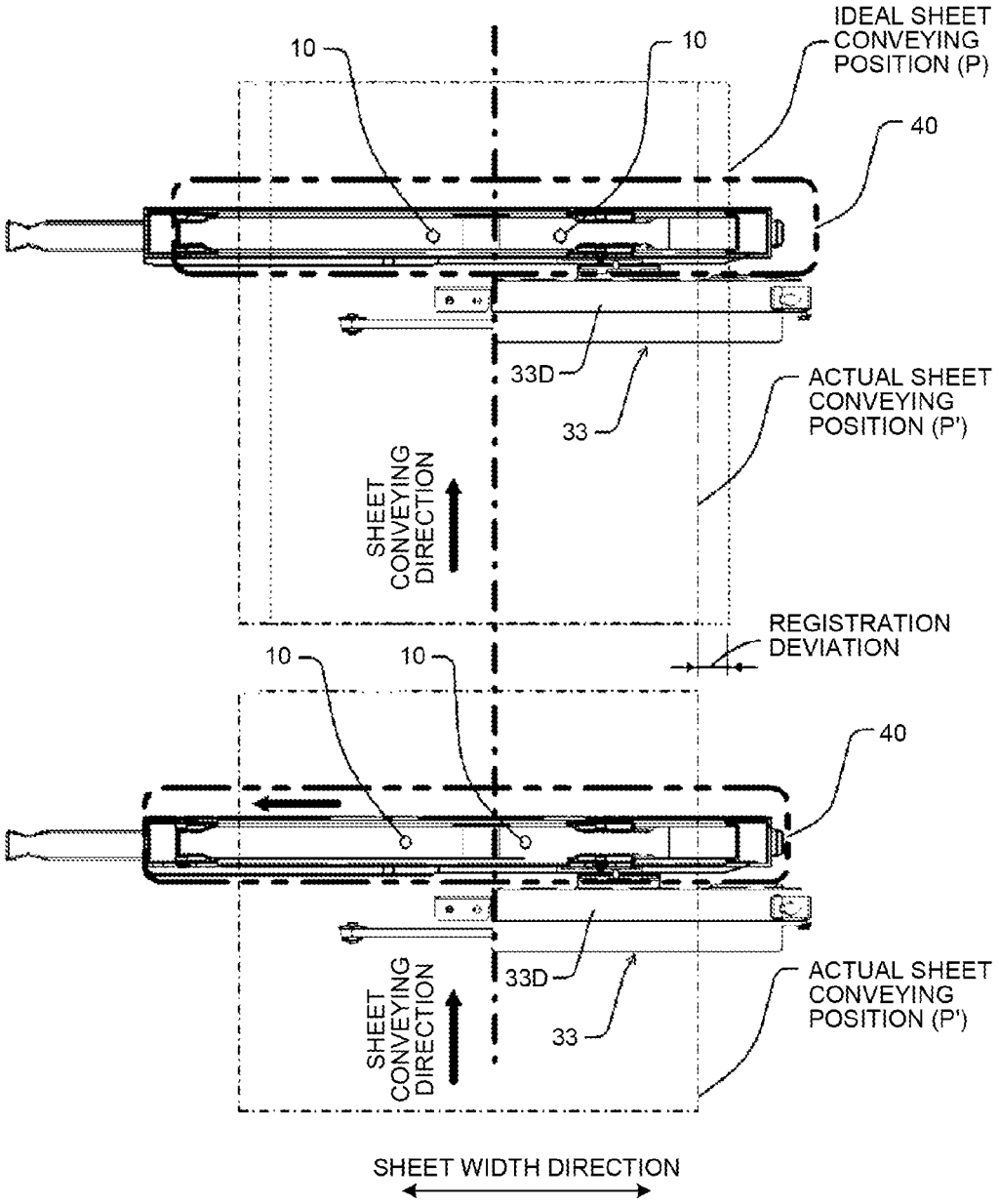
FIG. 9 is a plan view for explaining an operation of the registration detection unit used in the structure of the main portion illustrated in FIG. 7.

The movement of the registration detection unit 33 is performed as an action to adjust the punching positions in the sheet width direction as illustrated in FIG. 9. This action needs to be performed for the following reasons. When the sheet P on which an image is formed by the image forming apparatus is conveyed into the punching processing apparatus 1, a phenomenon occurs in some cases as illustrated in the upper area in FIG. 9, in which the actual sheet conveying position is off from an ideal sheet conveying position in the sheet width direction (hereinafter referred to as a registration deviation). For example, in punching two holes, it is ideal that two holes punched on the sheet P are positioned symmetrically about the center in the sheet width direction as the sheet P illustrated in the upper area in FIG. 9 with the dotted line. When the registration deviation occurs as a sheet P' illustrated in the upper area in FIG. 9 with the chain line, two holes are punched in such a manner that the center between the two holes punched on the sheet P' is off from the center of the sheet P' in the sheet width direction.

To eliminate the problem, a punching processing unit 40 illustrated in the upper area in FIG. 9 with the two-dot chain line moves to the position illustrated in the lower area in FIG. 9 with the two-dot chain line in the sheet width direction (the left direction in FIG. 9) by an amount of the deviation so as to correct the punching positions relative to the registration deviation in accordance with input information of the sheet width. As a result of the movement of the punching processing unit 40, two holes can be punched at punching positions symmetric about the center in the sheet width direction of the sheet P' (P).

The registration detection unit 33 includes the following structure as the structure to correct the punching positions. The registration detection unit 33 includes a registration detector 33D that includes a driving pulley 33B1, a driven pulley 33B2, a belt 33C wound along the pulleys, the stud 37, the supporting table 38 movable along the stud 37, and a detection piece 33D1. The driving pulley 33B1 is provided to the output shaft of a driving motor 33A. The driven pulley 33B2 is disposed at a position further outside from a maximum registration position in the sheet width direction. A part of the belt 33C is attached to the supporting table 38. In coordination with the movement of the belt 33C, the detection piece 33D1 provided to the registration detector 33D is positioned. The punching processing unit 20 moves by being guided on the basis of the position. As a result, two holes are punched on the sheet P' at positions symmetric about the center in the sheet width direction. That is, two holes are punched on the sheet P' in such positions that the positions face each other with an equal distance in the sheet width direction from the center in the sheet width direction.

When the detection of the registration position is performed on the basis of the reasons described above, the registration detection unit 33 moves to a position where the registration detection unit 33 can detect the registration amount. The linking member is caused to swing by utilizing the movement. This makes it possible to cause the punching scrap housing unit 32 engaged with the lever 34, which is one of the levers 34 and 35 included in the linking member, to move in the horizontal direction until when the engagement between the driven cam 35A and the cam portion 38A is released. Once the engagement between the driven cam 35A and the cam portion 38A is released, the punching scrap housing unit 32 and the levers 34 and 35 are caused to return to the initial positions by urging forces of the elastic bodies provided by being wound to the levers 34 and 45, and the elastic body provided to the punching scrap housing unit 32 on one side in the longitudinal direction.

The movement (displacement) of the punching scrap housing unit 32 generates a force to shake and flatten out punching scraps accumulated like a mountain in the punching scrap housing unit 32. As a result, the punching scraps accumulated like a mountain are broken down and flattened out by utilizing a force generated by the displacement of the punching scrap housing unit 32 and by the inertia when the punching scrap housing unit 32 returns.

Figure 10A:
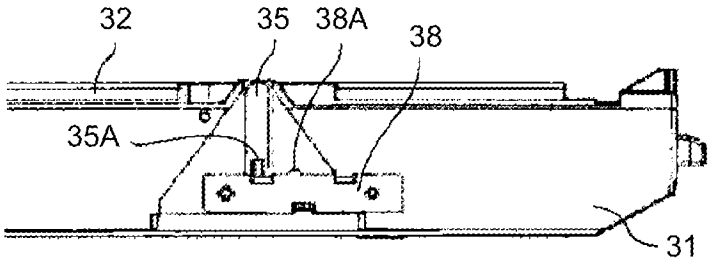
FIGS. 10A to 10D are schematic diagrams for explaining a coordination among the punching scrap housing unit, the linking member, and the registration detection unit illustrated in FIG. 8 (when moving in a forward direction)

FIGS. 10A to 10D are front views for explaining a coordination (corresponding relation) between the levers 34 and 35 included in the linking member and the supporting table 38 of the registration detection unit 33 when the punching scrap housing unit 32 is displaced. FIGS. 10A to 10D illustrate moving directions related to operation when the registration detection unit 33 detects the sheet end of the sheet P. FIG. 10A illustrates an initial state, i.e., the levers 34 and 35 included in the linking member are kept in a pendulous state and the registration detection unit 33 is positioned by an urging force of the elastic body at a position from which the registration detection unit 33 starts moving in a direction in which the registration detection unit 33 abuts sheet end edges of respective sheets having various sizes.

Figure 10B:
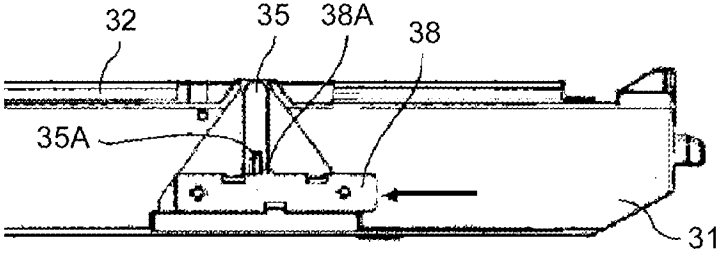

FIG. 10B illustrates a state in which the registration detection unit 33 is positioned at the sheet end edge. The registration detection unit 33 moves to the end edge position according to the sheet size in accordance with a signal from the control unit (not illustrated). At the end edge position, the cam portion 38A of the registration detection unit 33 illustrated in FIG. 8 abuts the driven cam 35A of the lever 35, which is the other lever included in the linking member.

Figure 10C:
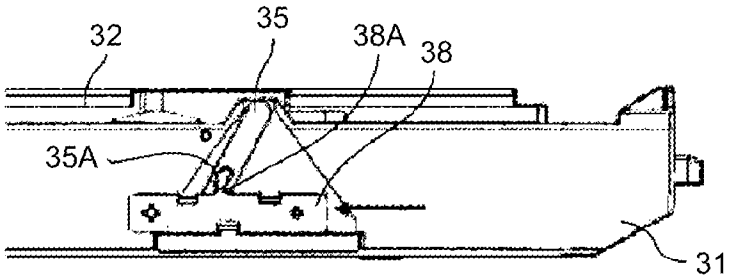

During the movement to the set sheet end edge position while the cam portion 38A of the registration detection unit 33 abuts the driven cam 35A of the lever 35, the levers 34 and 35 swing together as illustrated in FIG. 10C. Meanwhile, the punching scrap housing unit 32, with which the swing end of the lever 34 is engaged, is pushed and caused to move.

Figure 10D:
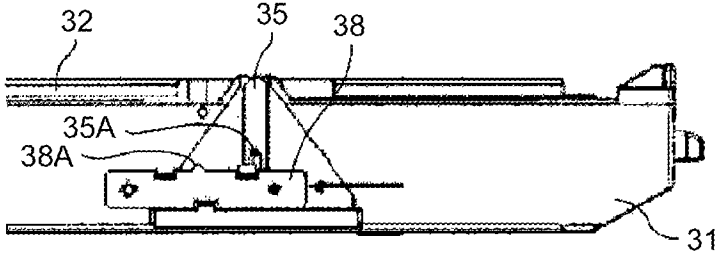

As a result of the further movement of the registration detection unit 33, the cam portion 38A is off from a swing trajectory of the driven cam 35A of the lever 35 included in the linking member pushed and moved by the cam portion 38A of the registration detection unit 33. As illustrated in FIG. 10D, the levers 34 and 35 included in the linking member and undergoing urging forces from the elastic bodies return to the original positions, and in coordination with the returning operation, the punching scrap housing unit 32 engaged with the lever 34 returns to the initial position.

Figure 11:
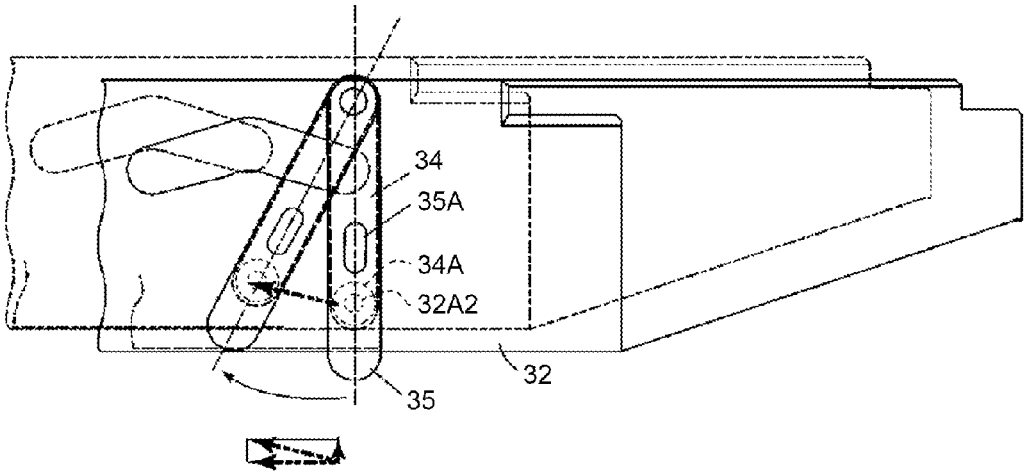
FIG. 11 is a front view for explaining the coordination among the components illustrated in FIGS. 10A to 10D.

FIG. 11 illustrates a relation between the levers 34 and 35 included in the linking member and the punching scrap housing unit 32 when the state illustrated in FIG. 10B changes to the state illustrated in FIG. 10C. As illustrated in FIG. 11, when the lever 35, out of the levers 34 and 35 included in the linking member, having the driven cam 35A pushed and moved by the cam portion 38A of the registration detection unit 33 swings, the lever 34 integrated with the lever 35 and indicated by the dotted line in FIG. 9 also swings. As a result, the engagement hole 34A of the lever 34 causes the punching scrap housing unit 32 to be displaced along the swing trajectory, while holding the outer circumferential surface of the engagement projection 32A2 provided to the wall surface of the punching scrap housing unit 32 by the inner circumferential surface of the engagement hole 34A in such a manner that the outer circumferential surface is rolled on the inner circumferential surface. This enables the punching scrap housing unit 32 to move in the horizontal direction as a component force of the force in the swing direction.

FIGS. 12D, 12E, 12A, and 12F are front views for explaining a coordination (corresponding relation) between the levers 34 and 35 included in the linking member and the supporting table 38 of the registration detection unit 33 when the punching scrap housing unit 32 is displaced. FIGS. 12D, 12E, 12A, and 12F illustrate moving directions related to operation when the registration detection unit 33 returns to the initial position after detecting the sheet end of the sheet P. As illustrated in FIGS. 12D, 12E, 12A, and 12F, when the registration detection unit 33 returns to the initial position after detecting the sheet end of the sheet P, the supporting table 38 of the registration detection unit 33 starts moving in the opposite direction from the position where the detection of the sheet end is completed, which is the state illustrated in FIG. 12D (FIG. 10D).

Figure 12E:
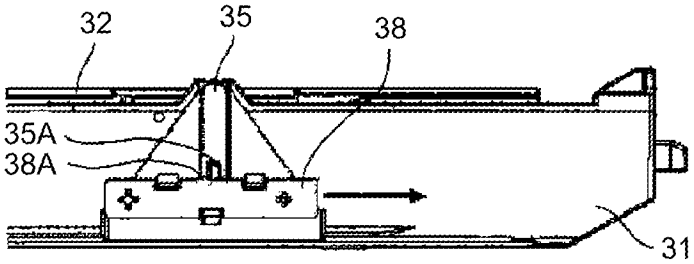
FIGS. 12D, 12E, 12A, and 12F are schematic diagrams for explaining a coordination among the punching scrap housing unit, the linking member, and the registration detection unit illustrated in FIG. 8 (when moving in a backward direction)
Figure 12F:
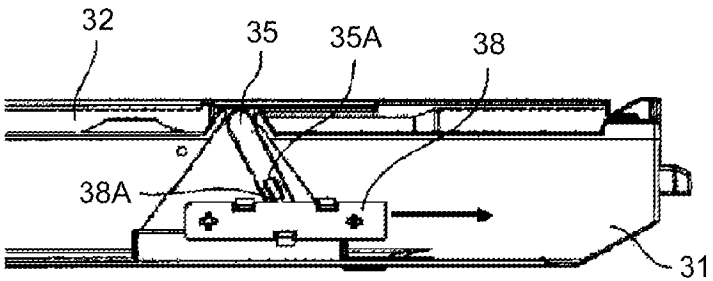

Thereafter, as illustrated in FIG. 12E, the cam portion 38A of the registration detection unit 33 abuts the driven cam 35A of the lever 35, which is one lever included in the linking member in the pendulous state, from the side opposite the side illustrated in FIG. 10B. Then, as illustrated in FIG. 12F, the registration detection unit 33 moves while the cam portion 38A of the registration detection unit 33 abuts the driven cam 35A of the lever 35, causing the levers 34 and 35 included in the linking member to swing together. Meanwhile, the punching scrap housing unit 32, with which the swing end of the lever 34 is engaged, is pushed and caused to move in the direction opposite the direction illustrated in FIG. 10C.

As for the relation between the levers 34 and 35 included in the linking member and the punching scrap housing unit 32, the levers 34 and 35 included in the linking member swing in the direction opposite the direction illustrated in FIG. 11. As a result, the engagement hole 34A of the lever 34 causes the punching scrap housing unit 32 to be displaced along the swing trajectory while holding the outer circumferential surface of the engagement projection 32A2 provided to the wall surface of the punching scrap housing unit 32 by the inner circumferential surface of the engagement hole 34A in such a manner that the outer circumferential surface is rolled on the inner circumferential surface. This enables the punching scrap housing unit 32 to move in the horizontal direction as a component force of the force in the swing direction in the same manner as that described with reference to FIG. 11 except that the movement direction in the horizontal direction is the opposite direction. Specifically, as illustrated in FIG. 12F, the punching scrap housing unit 32 is displaced in the direction opposite the direction illustrated in FIG. 10C.

Figure 12D:
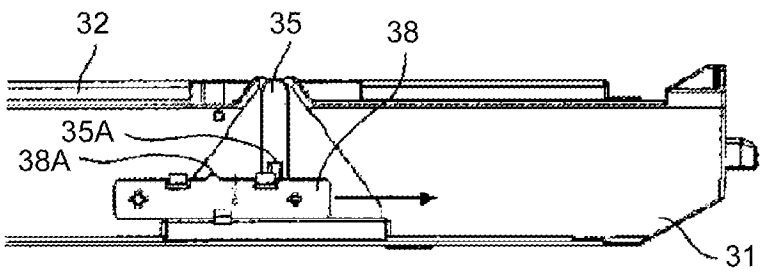
Figure 12A:
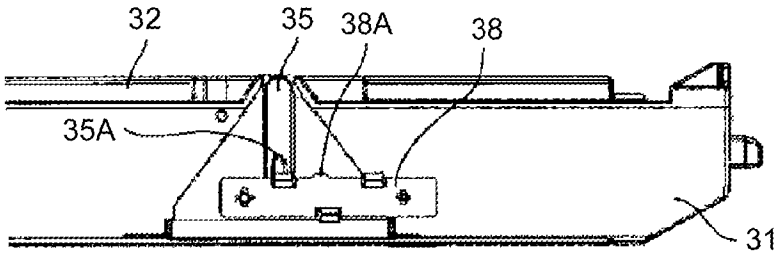

As a result of the further movement of the registration detection unit 33, the cam portion 38A is off from a swing trajectory of the driven cam 35A of the lever 35, which is included in the linking member pushed and moved by the cam portion 38A of the registration detection unit 33. As illustrated in FIG. 12A (FIG. 10A), the levers 34 and 35 included in the linking member and undergoing urging forces from the elastic bodies return to the original positions, and in coordination with the returning operation, the punching scrap housing unit 32 engaged with the lever 34 returns to the initial position. Thereafter, the supporting table 38 having the cam portion 38A of the registration detection unit 33 returns to the initial position and stops.

As described above, when the punching scrap housing unit 32 is caused to move in the horizontal direction by the linking member coordinated with the displacement of the registration detection unit 33 reciprocating, the punching scraps accumulated like a mountain are shaken and flattened out by inertia forces generated at the start of moving, the stoppage, and the reverse of the direction. As a result, the punching scraps accumulated like a mountain in the punching scrap housing unit 32 are broken down and flattened out. As described above, the punching scrap housing unit 32 can reciprocate by utilizing the cam portion 38A provided to the supporting table 38 of the registration detection unit 33 abutting the driven cam 35A of the lever 35 included in the linking member in the reciprocating direction. Because the punching scrap housing unit 32 can reciprocate in this way, one reciprocating movement of the registration detection unit 33 enables the punching scrap housing unit 32 to reciprocate a plurality of times. As a result, punching scraps accumulated like a mountain in the punching scrap housing unit 32 can be efficiently broken down and flattened out.

The punching scrap housing unit 32 coordinates with the return of the lever 34 to the initial state by utilizing the urging force of the elastic body acting on the lever 34 because the punching scrap housing unit 32 is engaged with the lever 34, which is one of the levers included in the linking member. The utilization of the force returning the lever 34 to the initial state does not require an urging unit such as a dedicated elastic body to be purposely provided to the punching scrap housing unit 32. As a result, the number of parts can be reduced, thereby enabling the punching processing apparatus 1 to be provided at a low cost.

An exemplary case is as follows. The registration detection unit 33 moves to determine the punching positions in the width direction of the sheet P as illustrated in FIG. 9 and FIG. 10B. The registration detector 33D detects the sheet end. Thereafter, the lever 34 can spontaneously return to the initial state as illustrated in FIG. 12A. Specifically, if the levers 34 and 35 included in the linking member can spontaneously return to the initial states until when the registration detection unit 33 returns to the initial position as illustrated in the order of FIG. 12D, FIG. 12E, FIG. 12F, and FIG. 12A, no urging unit is required to be provided to the punching scrap housing unit 32. In this case, the moving direction of registration detection unit 33 indicated in FIG. 9 and FIGS. 10B to 10D is defined as the forward direction while the moving direction of the registration detection unit 33 when returning to the initial position after detecting the sheet end as indicated in FIGS. 12D, 12E, and 12F is defined as the backward direction, one reciprocating movement in the forward and the backward directions is the displacement of the punching scrap housing unit 32. The displacement causes a force shaking and flattening out punching scraps accumulated like a mountain in the punching scrap housing unit 32 to be generated.

In addition, a speed control unit 39 (refer to FIG. 7) controls the driving motor 33A during the movement of the registration detection unit 33 in the forward and the backward directions. Specifically, the control is performed such that a speed of the cam portion 38A of the registration detection unit 33 when abutting the driven cam 35A of the linking member (lever 35) is identical in reciprocating. This control equalizes impulses acting on the punching scrap housing unit 32 in the forward and the backward directions through the levers 34 and 35 included in the linking member as a result of the movement of the registration detection unit 33, thereby enabling a moving amount in the horizontal direction of the punching scrap housing unit 32 to be identical in the forward and the backward directions. This makes it possible to generate a force shaking and flattening out punching scraps accumulated like a mountain in the punching scrap housing unit 32 and to shake and flatten out the punching scraps accumulated like a mountain mostly evenly in the sheet width direction in the punching scrap housing unit 32. As a result, the punching scraps can be more uniformly accumulated.

When the initial position of the registration detection unit 33 is set on the basis of a minimum registration amount, a position from which the registration detection unit 33 can move to the position where the registration detection unit 33 starts setting the registration amount is set as the initial position of the registration detection unit 33. This setting enables the swing amount of the linking member to cause the punching scrap housing unit 32 to move in the horizontal direction even if the registration amount of the sheet P is the minimum registration amount.

As described above, the punching processing apparatus 1 in the embodiment can cause the punching scrap housing unit 32 movable in the horizontal direction in the punching scrap collection member 31 to move in the horizontal direction in coordination with the movement of the registration detection unit 33. This makes it possible to shake and flatten out punching scraps accumulated like a mountain in the punching scrap housing unit 32 using only the existing registration detection unit 33 without providing a special mechanism for flattening the punching scraps accumulated like a mountain. As a result, the punching processing apparatus 1 can be provided without an increase in size and cost, and avoid false detection of the height of the accumulated punching scraps, i.e., a false determination that the container is in a full state even though the state has been corrected to the actual state.

As described above, the punching scrap housing unit 32 is movable in the horizontal direction in the punching scrap collection member 31, and the rotational shaft 36 is supported by the supporting hole 31B1 provided to the upper portion of the outer wall of the punching scrap collection member 31 in such a manner that the rotational shaft 36 straddles the supporting hole 31B1. The driven cam 35A of the lever 35 provided on one end side of the rotational shaft 36 is pushed and moved by the cam portion 38A provided to the registration detection unit 33. The movement of the driven cam 35A causes the engagement projection 32A2 formed on the sidewall of the punching scrap housing unit 32 and engaged with the tubular engagement hole 34A of the lever 34 included in the linking member to be displaced, thereby enabling the punching scrap housing unit 32 to be pushed and caused to move in the horizontal direction.

This makes it possible to simply structure the coordinating mechanism that causes the movement of the punching scrap housing unit 32 to coordinate with the movement of the registration detection unit 33 in the width direction of the sheet P, thereby enabling the cost of the coordinating mechanism to be reduced. The rotational shaft 36 is supported by the supporting hole 31B1 provided to the upper portion of the sidewall of the punching scrap collection member 31 in such a manner that the rotational shaft 36 straddles the supporting hole 31B1. This structure makes it possible to provide the lever 34 having the driven hole 34A engaged with the engagement projection 32A2 of the punching scrap housing unit 32 between the sidewall of the punching scrap housing unit 32 and the sidewall of the punching scrap collection member 31, and to prevent punching scraps from scattering outside the punching scrap housing unit 32 due to the contact made between the punching scraps and the lever 34. The structure in which the lever 34 is provided between the sidewall of the punching scrap housing unit 32 and the sidewall of the punching scrap collection member 31 can avoid an increase in size, such as the sidewall of the punching scrap collection member 31 and the lever 34 are enlarged outward, thereby enabling the punching scrap collection member 31 and the punching scrap processing mechanism 30 as well to be downsized.

Figure 13:
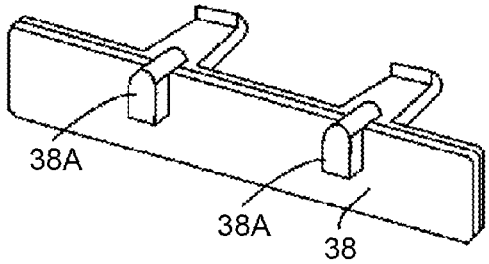
FIG. 13 is a schematic diagram for explaining a modification of the cam portion illustrated in FIG. 8.

In the embodiment, only one cam portion 38 is provided to the registration detection unit 33 and the cam portion 38 collides with the driven cam 35A of the lever 35 in one reciprocating movement. The invention, however, is not limited to the structure. To increase the efficiency of breaking punching scraps accumulated like a mountain, the number of cam portion 38 of the registration detection unit 33 can be increased as illustrated in FIG. 13. Such a structure can increase the number of collisions with the driven cam 35A of the lever 35, thereby enabling impact acting on punching scraps to be increased. As a result, punching scraps accumulated like a mountain in the punching scrap housing unit 32 can be readily flattened out.

Figure 14:
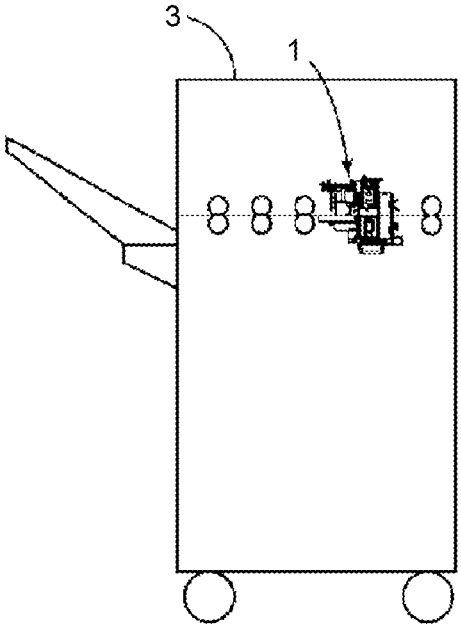
FIG. 14 is a schematic diagram for explaining an example of an installation of the punching processing apparatus in the embodiment.

In the embodiment, the punching processing apparatus 1 is disposed between the image forming apparatus 2 and the sheet post-processing apparatus 3. The invention, however, is not limited to the structure. For example, as illustrated in FIG. 14, the punching processing apparatus 1 can be built into the sheet post-processing apparatus 3. In this case, the punching processing is performed prior to the binding processing performed by the post-processing apparatus.

Figure 15:
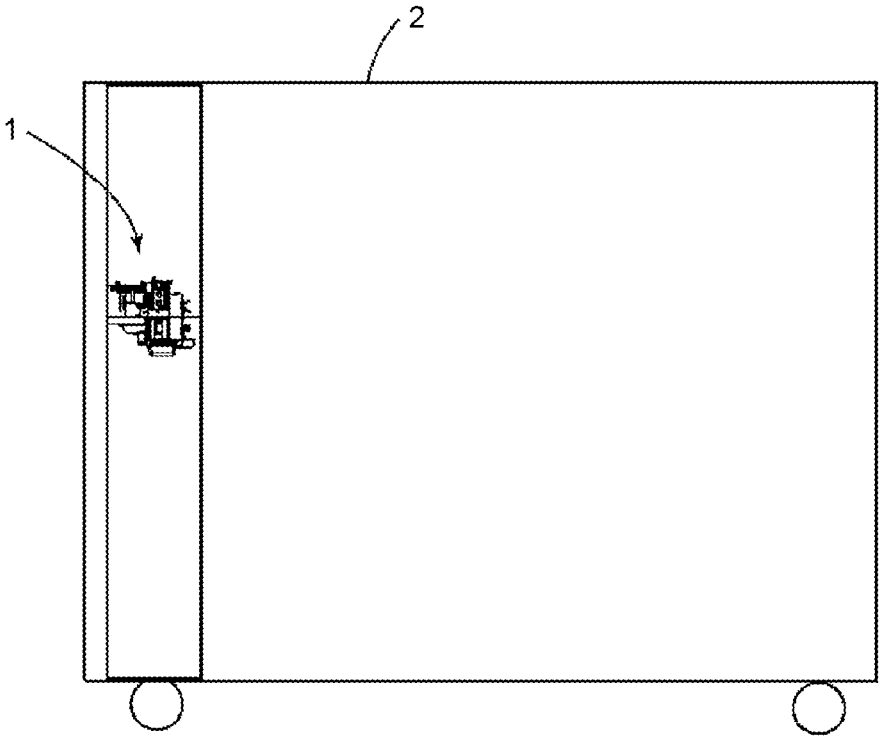
FIG. 15 is a schematic diagram for explaining another example of the installation of the punching processing apparatus in the embodiment.

For another example, as illustrated in FIG. 15, the punching processing apparatus 1 can be built into the image forming apparatus 2 as a part of the image forming apparatus 2. This structure can reduce the conveying time of the sheet P, because the punching processing can be performed after the image forming processing as a preparation for the post-processing.

Figure 16:
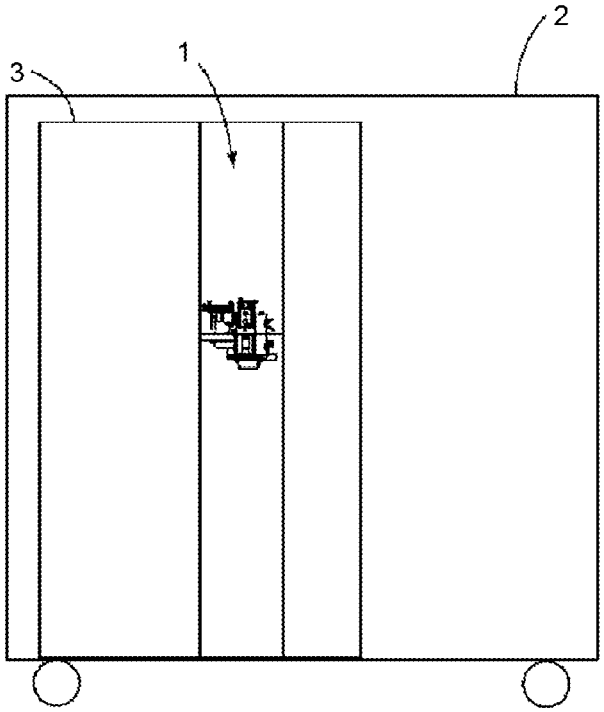
FIG. 16 is a schematic diagram for explaining still another example of the installation of the punching processing apparatus in the embodiment.
Figure 17:
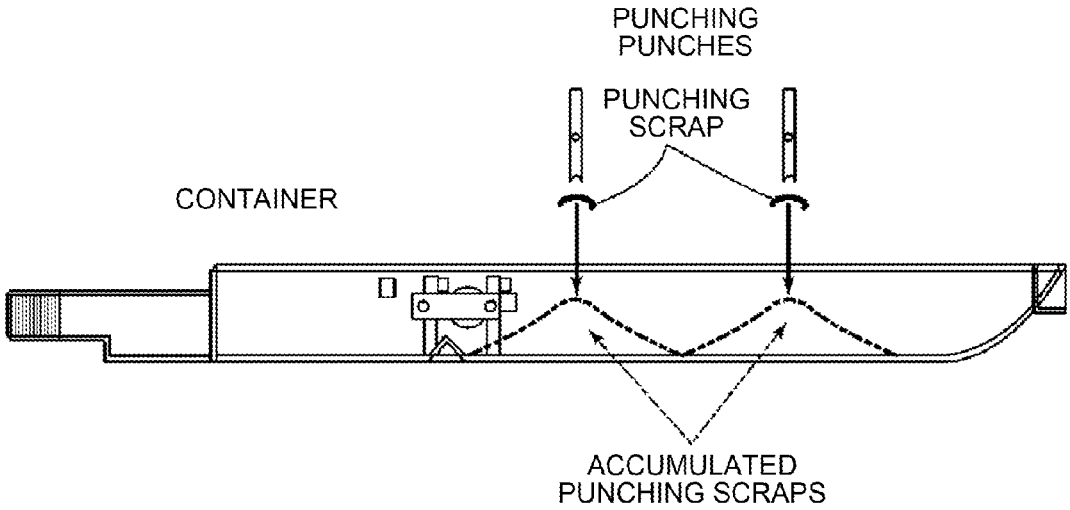
FIG. 17 is a schematic view for explaining a collection state of punching scraps.

As a modification of the structure illustrated in FIG. 14, as illustrated in FIG. 16, the sheet post-processing apparatus 3 including the punching processing apparatus 1 can be provided in the image forming apparatus 2 such that the punching processing and the post-processing can be collectively performed by the image forming apparatus 2 after the image forming processing is completed.

In the embodiment, the image forming apparatus 2 is the electrophotographic image forming apparatus employing the intermediate transfer method and the tandem system. The invention, however, is not limited to this structure. For example, the invention can also be applied to an electrophotographic monochrome image forming apparatus employing a direct transfer method. In addition, the invention can be applied to a wet electrophotographic image forming apparatus using a liquid developer and an inkjet image forming apparatus including a liquid droplet ejecting head ejecting ink droplets.

The above descriptions are represented by way of example. The invention has particular advantages in the following aspects.

Aspect A

A punching processing apparatus, such as the punching processing apparatus 1 including a punching scrap collection member such as the punching scrap collection member 31 provided to the punching scrap processing mechanism 30 disposed at a position where punching scraps produced after punching a sheet such as the sheet P drop, includes a punching scrap housing unit such as the punching scrap housing unit 32 that is disposed in the punching scrap collection member and movable in the horizontal direction, and a registration detection unit such as the registration detection unit 33 that is movable in the width direction of the sheet for detecting a positional deviation amount of the sheet in the width direction when the position of the sheet in the width direction is adjusted so as to meet the punching positions. The punching scraps accumulated in the punching scrap housing unit are shaken and flattened out by causing the punching scrap housing unit to move in the horizontal direction in coordination with the movement of the registration detection unit.

As described in the embodiment, this structure can provide a punching processing apparatus that can be provided without an increase in size and cost and avoid false detection of the height of the accumulated punching scraps, i.e., a false determination that the container is in a full state even though the state has been corrected to the actual state.

Aspect B

In aspect A, the punching processing apparatus includes a linking member that includes swingable levers such as the levers 34 and 35 and has a swing base end such as the rotational shaft 36 supported by a swing supporter such as the supporting hole 31B1 provided to an upper portion of a sidewall of the punching scrap collection member such as the punching scrap collection member 31 facing a sidewall of the punching scrap housing unit, and moving directions of the punching scrap housing unit such as the punching scrap housing unit 32 and the registration detection unit such as the registration detection unit 33 are set to be identical. The linking member is supported in such a manner that the swing base end straddles the swing supporter of the punching scrap collection member, one swing end of the linking member such as the driven hole 34A of the lever 34 straddling the swing supporter of the punching scrap collection member is engaged with an engagement portion such as the engagement projection 32A2 formed on the sidewall of the punching scrap housing unit, and the other swing end of the linking member such as the lever 35 is provided with a driven cam portion such as the driven cam 35A that can abut a cam portion such as the cam portion 38A included in the supporting table 38 provided to the registration detection unit.

As described in the embodiment, this structure has the following advantages. This structure makes it possible to simply structure the coordinating mechanism that causes the movement of the punching scrap housing unit to coordinate with the movement of the registration detection unit in the width direction of the sheet such as the sheet P, thereby enabling the cost of the coordinating mechanism to be reduced. The swing base end of the linking member is supported in such a manner that the swing base end straddles the swing supporter provided to the upper portion of the sidewall of the punching scrap collection member. This structure allows the swing end engaged with the engagement portion of the punching scrap housing unit to be provided between the sidewall of the punching scrap housing unit and the sidewall of the punching scrap collection member. As a result, this also makes it possible to prevent punching scraps from scattering outside the punching scrap housing unit due to a contact made between the linking member and the punching scraps.

Aspect C

In aspect A or B, the punching scrap housing unit such as the punching scrap housing unit 32 can reciprocate by utilizing the cam portion, such as the cam portion 38A that is provided to the supporting table 38 of the registration detection unit such as the registration detection unit 33, abutting the driven cam such as the driven cam 35A of the lever 35 included in the linking member in a reciprocating direction when the linking member including the levers 34 and 35 is swinging. As described in the embodiment, this structure enables the punching scrap housing unit to reciprocate a plurality of times by one reciprocating movement of the registration detection unit. As a result, punching scraps accumulated like a mountain in the punching scrap housing unit can be efficiently broken down and flattened out.

Aspect D

In any of aspects A to C, the punching scrap housing unit such as the punching scrap housing unit 32 is given a behavior to return to a position, such as the initial position, from which the punching scrap housing unit is pushed and caused to move when the cam portion, such as the cam portion 38A provided to the supporting table 38 of the registration detection unit such as the registration detection unit 33, is off from a swing trajectory of the driven cam such as the driven cam 35A of the lever 35 that the cam portion 38A abuts when the linking member including the levers 34 and 35 is swinging. As described in the embodiment, an urging force, which causes one member such as the lever 34 included in the linking member to return to the initial state, of the elastic body can be used, thereby requiring no dedicated urging unit to be provided to the punching scrap housing unit. As a result, the number of parts can be reduced, thereby enabling the punching processing apparatus such as the punching processing apparatus 1 to be provided at a low cost.

Aspect E

In any of aspects A to D, the registration detection unit such as the registration detection unit 33 can reciprocate, and a speed control unit such as the speed control unit 39 is provided that causes a speed of the cam portion such as the cam portion 38A provided to the supporting table 38 of the registration detection unit when abutting the driven cam such as the driven cam 35A of the lever 35 included in the linking member including the levers 34 and 35 to be identical in the reciprocating movement of the registration detection unit. As described in the embodiment, this structure makes it possible to shake and flatten out punching scraps accumulated like a mountain in the punching scrap housing unit such as the punching scrap housing unit 32 mostly and evenly in the sheet width direction in the punching scrap housing unit. As a result, the punching scraps can be more uniformly accumulated.

Aspect F

A sheet post-processing apparatus that can perform binding processing on a sheet such as the sheet P, such as the sheet post-processing apparatus 3, includes the punching processing apparatus such as the punching processing apparatus 1 in any of aspects A to E. As described in the embodiment, the sheet post-processing apparatus can be provided that has the same advantage as the punching processing apparatus in any of aspects A to E.

Aspect G

An image forming apparatus that forms an image on a sheet such as the sheet P, such as the image forming apparatus 2, includes a sheet post-processing apparatus. In the image forming apparatus, the sheet post-processing apparatus is the sheet post-processing apparatus in aspect F such as the sheet post-processing apparatus 3. As described in the embodiment, the image forming apparatus can be provided that has the same advantage as the sheet post-processing apparatus in aspect F.

Aspect H

An image forming apparatus that forms an image on a sheet such as the sheet P, such as the image forming apparatus 2, includes a punching processing apparatus. In the image forming apparatus, the punching processing apparatus is the punching processing apparatus in any of aspects A to E such as the punching processing apparatus 1. As described in the embodiment, the image forming apparatus can be provided that has the same advantage as the punching processing apparatus in any of aspects A to E.

The embodiments can cause the punching scrap housing unit movable in the horizontal direction in the punching scrap collection member to move in the horizontal direction in coordination with the movement of the registration detection unit. This makes it possible to shake and flatten out punching scraps accumulated like a mountain in the punching scrap housing unit using only the existing registration detection unit without providing a special driving mechanism for flattening out the punching scraps accumulated like a mountain.

The embodiments can provide the punching processing apparatus that can be provided without an increase in size and cost, and avoid false detection of the height of the accumulated punching scraps, i.e., a false determination that the container is in a full state even though the state has been corrected to the actual state.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A punching processing apparatus, comprising:

a punching scrap collection member that is disposed at a position where punching scraps produced after punching a sheet drop;

a punching scrap housing unit that is disposed in the punching scrap collection member and movable in a horizontal direction;

a registration detection unit that is movable in a width direction of the sheet for detecting a positional deviation amount of the sheet in the width direction when a position of the sheet in the width direction is adjusted so as to meet a punching position; and a linking member that has a swing base end supported by a swing supporter provided to an upper portion of a sidewall of the punching scrap collection member facing a sidewall of the punching scrap housing unit, and is swingable, wherein:

moving directions of the punching scrap housing unit and the registration detection unit are set to be identical, the linking member is supported in such a manner that the swing base end straddles the swing supporter of the punching scrap collection member, and one swing end of the linking member straddling the swing supporter of the punching scrap collection member is engaged with an engagement portion formed on the sidewall of the punching scrap housing unit and the other swing end of the linking member is provided with a driven cam portion capable of abutting a cam portion provided to the registration detection unit, and punching scraps accumulated in the punching scrap housing unit are shaken and flattened out by causing the punching scrap housing unit to move in the horizontal direction in coordination with the movement of the registration detection unit.

2. The punching processing apparatus according to claim 1, wherein the punching scrap housing unit is capable of reciprocating by the cam portion of the registration detection unit abutting the driven cam of the linking member in a reciprocating direction when the linking member is swinging.

3. The punching processing apparatus according to claim 1, wherein the punching scrap housing unit is configured to return to a position from which the punching scrap housing unit is pushed and caused to move, when the cam portion of the registration detection unit is off from a swing trajectory of the driven cam that the cam portion abuts in the case that the linking member is swinging.

4. The punching processing apparatus according to claim 1, wherein the registration detection unit is capable of reciprocating, the punching processing apparatus further comprising a speed control unit that causes a speed of the cam portion of the registration detection unit when abutting the driven cam of the linking member to be identical in reciprocating movements of the registration detection unit.

5. A sheet post-processing apparatus capable of performing binding processing on a sheet, the sheet post-processing apparatus including a punching processing apparatus, the punching processing apparatus comprising:

a punching scrap collection member that is disposed at a position where punching scraps produced after punching a sheet drop;

a punching scrap housing unit that is disposed in the punching scrap collection member and movable in a horizontal direction;

a registration detection unit that is movable in a width direction of the sheet for detecting a positional deviation amount of the sheet in the width direction when a position of the sheet in the width direction is adjusted so as to meet a punching position; and a linking member that has a swing base end supported by a swing supporter provided to an upper portion of a sidewall of the punching scrap collection member facing a sidewall of the punching scrap housing unit, and is swingable, wherein:

moving directions of the punching scrap housing unit and the registration detection unit are set to be identical, the linking member is supported in such a manner that the swing base end straddles the swing supporter of the punching scrap collection member, and one swing end of the linking member straddling the swing supporter of the punching scrap collection member is engaged with an engagement portion formed on the sidewall of the punching scrap housing unit and the other swing end of the linking member is provided with a driven cam portion capable of abutting a cam portion provided to the registration detection unit, and punching scraps accumulated in the punching scrap housing unit are shaken and flattened out by causing the punching scrap housing unit to move in the horizontal direction in coordination with the movement of the registration detection unit.

6. The sheet post-processing apparatus according to claim 5, wherein the punching scrap housing unit is capable of reciprocating by the cam portion of the registration detection unit abutting the driven cam of the linking member in a reciprocating direction when the linking member is swinging.

7. The sheet post-processing apparatus according to claim 5, wherein the punching scrap housing unit is configured to return to a position from which the punching scrap housing unit is pushed and caused to move, when the cam portion of the registration detection unit is off from a swing trajectory of the driven cam that the cam portion abuts in the case that the linking member is swinging.

8. The sheet post-processing apparatus according to claim 5, wherein the registration detection unit is capable of reciprocating, the punching processing apparatus further comprising a speed control unit that causes a speed of the cam portion of the registration detection unit when abutting the driven cam of the linking member to be identical in reciprocating movements of the registration detection unit.

9. An image forming apparatus that forms an image on a sheet, the image forming apparatus including a punching processing apparatus, the punching processing apparatus comprising:

a punching scrap collection member that is disposed at a position where punching scraps produced after punching a sheet drop;

a punching scrap housing unit that is disposed in the punching scrap collection member and movable in a horizontal direction;

a registration detection unit that is movable in a width direction of the sheet for detecting a positional deviation amount of the sheet in the width direction when a position of the sheet in the width direction is adjusted so as to meet a punching position; and a linking member that has a swing base end supported by a swing supporter provided to an upper portion of a sidewall of the punching scrap collection member facing a sidewall of the punching scrap housing unit, and is swingable, wherein:

moving directions of the punching scrap housing unit and the registration detection unit are set to be identical, the linking member is supported in such a manner that the swing base end straddles the swing supporter of the punching scrap collection member, and one swing end of the linking member straddling the swing supporter of the punching scrap collection member is engaged with an engagement portion formed on the sidewall of the punching scrap housing unit and the other swing end of the linking member is provided with a driven cam portion capable of abutting a cam portion provided to the registration detection unit, and punching scraps accumulated in the punching scrap housing unit are shaken and flattened out by causing the punching scrap housing unit to move in the horizontal direction in coordination with the movement of the registration detection unit.

10. An image forming apparatus according to claim 9, further comprising a sheet post-processing apparatus capable of performing binding processing on a sheet, wherein the sheet post-processing apparatus includes the punching processing apparatus.

11. The image forming apparatus according to claim 9, wherein the punching scrap housing unit is capable of reciprocating by the cam portion of the registration detection unit abutting the driven cam of the linking member in a reciprocating direction when the linking member is swinging.

12. The image forming apparatus according to claim 9, wherein the punching scrap housing unit is configured to return to a position from which the punching scrap housing unit is pushed and caused to move, when the cam portion of the registration detection unit is off from a swing trajectory of the driven cam that the cam portion abuts in the case that the linking member is swinging.

13. The image forming apparatus according to claim 9, wherein the registration detection unit is capable of reciprocating, the punching processing apparatus further comprising a speed control unit that causes a speed of the cam portion of the registration detection unit when abutting the driven cam of the linking member to be identical in reciprocating movements of the registration detection unit.

* * * * *